US006416123B1

(12) United States Patent
Bell

(10) Patent No.: US 6,416,123 B1
(45) Date of Patent: Jul. 9, 2002

(54) ROCKING CHAIR CONVERSION APPARATUS

(75) Inventor: Michael J. Bell, Liverpool, NY (US)

(73) Assignee: Alterra Holdings Corporation, Tigard, OR (US)

( * ) Notice: Subject to any disclaimer, the term of this patent is extended or adjusted under 35 U.S.C. 154(b) by 0 days.

(21) Appl. No.: 09/928,152

(22) Filed: Aug. 10, 2001

(51) Int. Cl.[7] ..... A47C 13/00
(52) U.S. Cl. ..... 297/133
(58) Field of Search ..... 297/133, 33

(56) References Cited

U.S. PATENT DOCUMENTS 1,295,382 A * 2/1919 Stelzer ..... 297/133
1,566,157 A * 12/1925 Michaelson ..... 297/133
2,662,580 A * 12/1953 Gottfried ..... 297/133
5,833,307 A * 11/1998 Leach et al. ..... 297/133
5,839,781 A * 11/1998 Knape ..... 297/133
6,086,147 A * 7/2000 Gladstone ..... 297/133

* cited by examiner

*Primary Examiner*—Peter R. Brown
(74) *Attorney, Agent, or Firm*—Foley & Lardner

(57) ABSTRACT

A rocking chair conversion component having at least one arcuate member and at least one socket. In one embodiment, the socket has planar members positioned such that a gap forms between each of the planar members, allowing the socket to sandwich a flange occurring at the bottom of a chair, thus coupling the chair to the rocking chair conversion component and producing a stable rocking chair.

4 Claims, 5 Drawing Sheets

ROCKING CHAIR CONVERSION APPARATUS

FIELD OF THE INVENTION

The invention relates to components that can be used to convert a chair into a rocking chair. More specifically, the invention relates to a rocker rung component that attaches to the base of a chair without need for extensive fastening. In addition, the invention relates to a chair and rocker component forming a rocking chair.

BACKGROUND OF THE INVENTION

Rocking chairs are a pleasant means of relaxation; however rocking chairs by themselves have a number of drawbacks. Their arcuate bottom rungs do not allow adjustment, and rocking chairs are therefore not amenable to stable sitting without elaborate wedging or fastening of the rungs. Further, rocking chairs are more difficult to manufacture than normal chairs, as well as more difficult to ship to customers. Although rocking chairs are enjoyed in many homes, they can not fill all of the sitting needs of a household. Other chairs must therefore be available in addition to a rocking chair, requiring additional space.

SUMMARY OF THE INVENTION

It is, therefore, an object of the invention to provide an improved component for converting a normal chair into a rocking chair.

It is a further object of the invention to provide an improved component for converting a normal chair into a rocking chair that does not require complicated fastening or extensive effort to attach.

It is a further object of the invention to provide an improved component for converting a normal chair into a rocking chair that prevents the chair from slipping during rocking.

It is a further object of the invention to provide an improved component for converting a normal chair into a rocking chair that is easy to manufacture.

It is a further object of the invention to provide an improved component for converting a normal chair into a rocking chair that is easy to ship.

It is a further object of the invention to provide an improved rocking chair composed of a normal chair affixed to a rocking chair conversion apparatus.

BRIEF DESCRIPTION OF THE DRAWINGS

Some of the various embodiments of the invention are depicted in the Figures, in which like reference numerals denote like components throughout and in which.

DETAILED DESCRIPTION OF THE PREFERRED EMBODIMENTS

Figure 1:
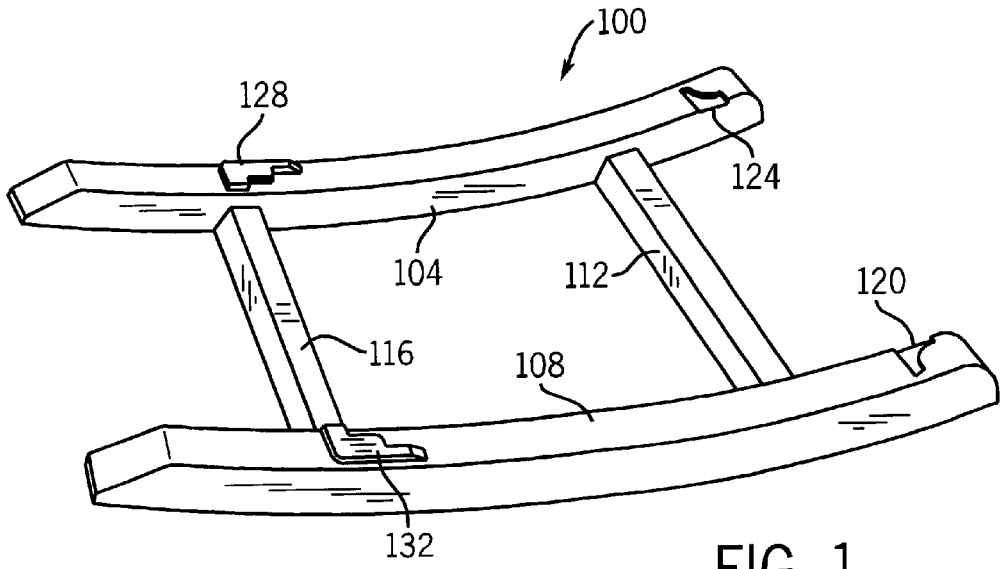
FIG. 1 a side perspective view of an embodiment rocker rung component.

A preferred embodiment of the invention is shown in FIG. 1. A rocking chair conversion component 100 (hereinafter "component 100") is shown with arcuate members forming rocker rungs 104 and 108. The component 100 also has rung connectors 112 and 116, front chair-leg sockets 120 and 124 and rear chair-leg sockets 128 and 132. The component 100 can be coupled to the bottoms of the legs of a normal chair to convert the normal chair into a rocking chair.

The rocker rungs 104 and 108 are also curved to allow rocking as in a conventional rocking chair. The rungs 104 and 108 are can be positioned parallel to one another to create a uniform sitting base, or can be non-parallel to the fit different chair-leg spacing (see FIG. 2). In the present embodiment, the rungs 104 and 108 are substantially parallel, but the distance between the rungs 104 and 108 narrows toward the front of the component 100. The rung connectors 112 and 116 provide stability and prevent torsional forces from destroying the spatial relationship of the rungs 104 and 108. The front chair-leg sockets 120 and 124 allow the insertion of part of a chair leg, as do the rear chair-leg sockets 128 and 132, and this feature is described in more detail hereinafter.

The preferred embodiment component 100 shown in FIG. 1 is designed so that the center of gravity of a chair 200 (see FIG. 2) affixed to the component 100 will cause the component 100 to rest on a central portion of the arcuate rocking rungs 104 and 108, causing the chair 200 to begin in a normal sitting position. The placement of the sockets 120, 124, 132 and 128 can be varied throughout the length, depth and width of the rocker rungs 104 and 108 according to the requirements of the particular chair involved and the restrictions placed upon the component 100 by manufacturing, shipping and aesthetic considerations.

In the preferred embodiment shown in FIG. 1, the component 100 is advantageously molded from plastic via injection molding or any other conventional manufacturing process to create a single-piece unit. A four piece unit is also contemplated as advantageous. Of course, a variety of manufacturing techniques and component arrangements are possible and will be apparent to a person of ordinary skill in the art.

Figure 2:
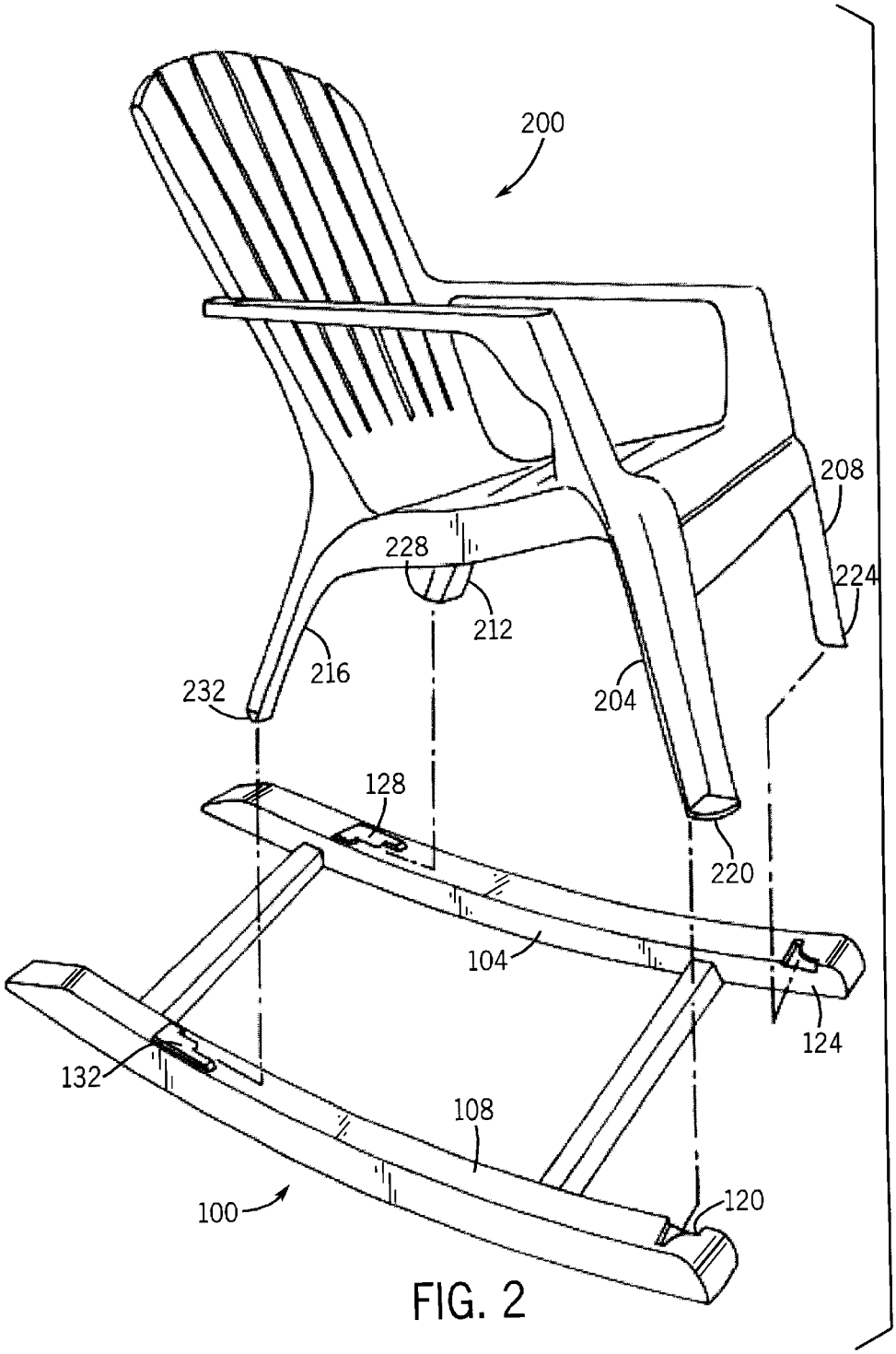
FIG. 2 is a side perspective of an embodiment showing a chair connection to a rocker rung component.

FIG. 2 shows the coupling of the chair 200 to the component 100. The chair 200 has legs 204, 208, 212, and 216, with leg flanges 220, 224 (hidden from view), 228 (hidden from view) and 232. The component 100 has again four sockets 120, 124, 128 and 132. The rocking chair 200 can be affixed to the component 100 by sliding the flange 228 rearwards underneath the socket cover 504 (see FIG. 5) of the socket 128 (shown in more detail in FIGS. 5 and 6), sliding the flange 232 rearwards underneath the socket cover 504 (see FIG. 5) of the socket 132, sliding the flange 220 sideways underneath the socket cover 304 (see FIG. 3) of the socket 120 (shown in more detail in FIGS. 3 and 4), and by sliding the flange 224 sideways underneath the socket cover 304 (see FIG. 3) of the socket 124. In the embodiment as shown in FIG. 2, the chair 200 is made from plastic or other material flexible enough so that the legs 204, 208, 212 and 216 can be bent during the coupling process. The legs 204, 208, 212 and 216 are, however, endowed with sufficient elastic memory of their original shape, such that the chair legs 204, 208, 212 and 216 are contained by the sockets 120, 124, 128 and 132, and will not slip during rocking motion.

In the embodiment shown in FIG. 2, the sockets 128 and 132 are raised along the depths of the rungs 104 and 108 relative to the corresponding front sockets 124 and 120, and further require a different angle of entry by the chair flanges 228 and 232. The overall coupling of the chair 200 with the component 100 can therefore be accomplished by first sliding the back flanges 228 and 232 rearward into the sockets 128 and 132, and then bending the chair legs 204 and 208 inward (toward one another), and sliding the flanges 220 and 224 underneath the socket covers 304 (see FIG. 3) of sockets 120 and 124 respectively. Alternately, the legs 204 and 208 can be first installed, followed by the coupling of the legs 212 and 216 with the sockets 128 and 132 respectively by bending each of the legs 212 and 216 toward the front leg and sliding each of the flanges 228 and 232 into their respective sockets 128 or 132. This arrangement of the sockets 120, 124, 128 and 132 is advantageous in that slipping from front to back and side to side during rocking is prevented by the walls of the sockets 120, 124, 128 and 132. In addition, the forces generated when the legs 204, 208, 212 and 216 are bent inward are used advantageously by the embodied arrangement shown in FIG. 2. The arrangement, placement and shape of the sockets, however, can be varied from the arrangement, placement and shape depicted in this embodiment while still producing a slip-free rocking chair.

Figure 3:
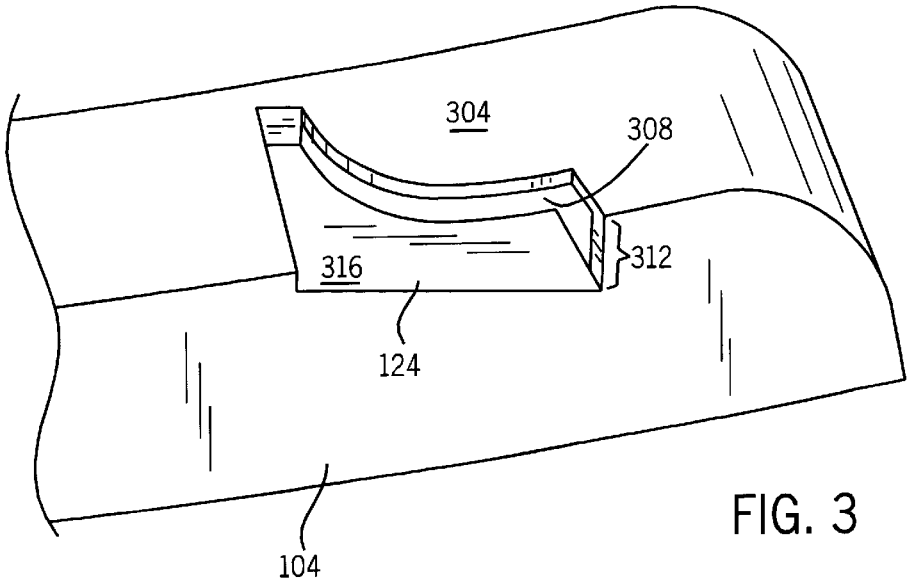
FIG. 3 is a cut-away side perspective view of an empty chair-leg socket of a rocker rung component.

Details of the coupling between the chair 200 and the component are shown in FIGS. 3 through 6. FIG. 3 shows the rocker rung 104 with the socket 124 that can be used with embodiments of the invention. The socket 124 has the socket cover 304, a socket opening 308, a socket depth 312, and a socket bottom 316.

The chair-leg flange 220 (shown in FIG. 4) can fit between the socket cover 304, the edge of which is curved to match the shape of the inner wall of a chair leg, and the socket bottom 316, thereby fitting into the socket opening 308. The chair-leg flange 220 (shown in FIG. 4) preferably has a thickness of less than or approximately equal to the socket depth 312. Of course, the exact placement and shape of the socket are advantageous but not critical so long as the simplicity and slip-free character of the design is maintained.

Figure 4:
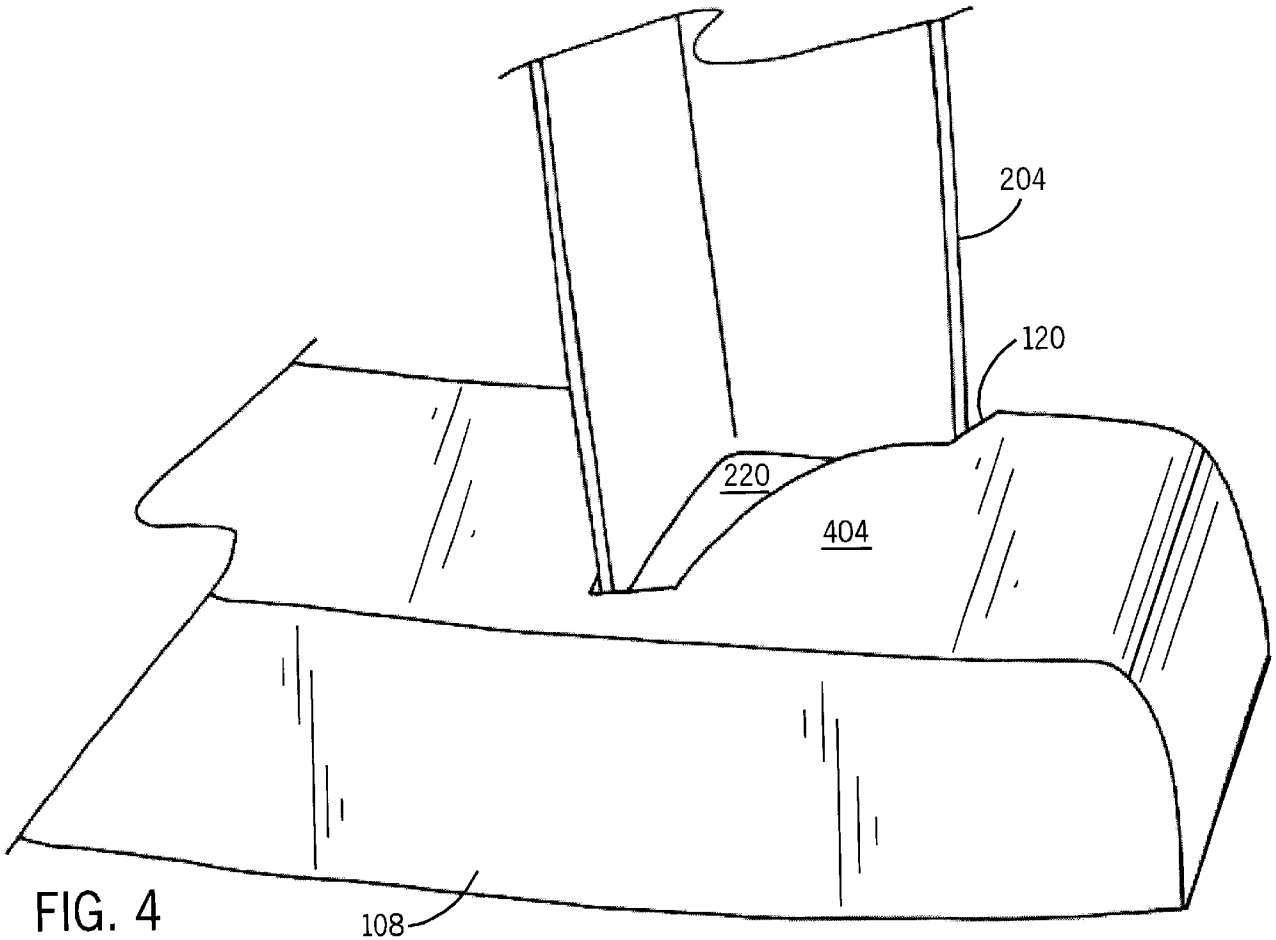
FIG. 4 is a cut-away side perspective view showing a chair-leg socket of a rocker rung component with a chair leg therein.

FIG. 4 shows the coupling of the chair leg 204 with the socket 120 in the rocker rung 108. The socket 120 again has the socket cover 404 and the socket bottom 316 (see FIG. 3). The chair leg flange 220 of FIG. 4 fits between the socket cover 404 and the socket bottom 316. The force created by the bending of the leg 204 prevents the leg 204 from slipping parallel to the surfaces of the socket cover 404 and the chair-leg flange 220. The socket cover 404 and the socket bottom 316 prevent vertical slipping.

Figure 5:
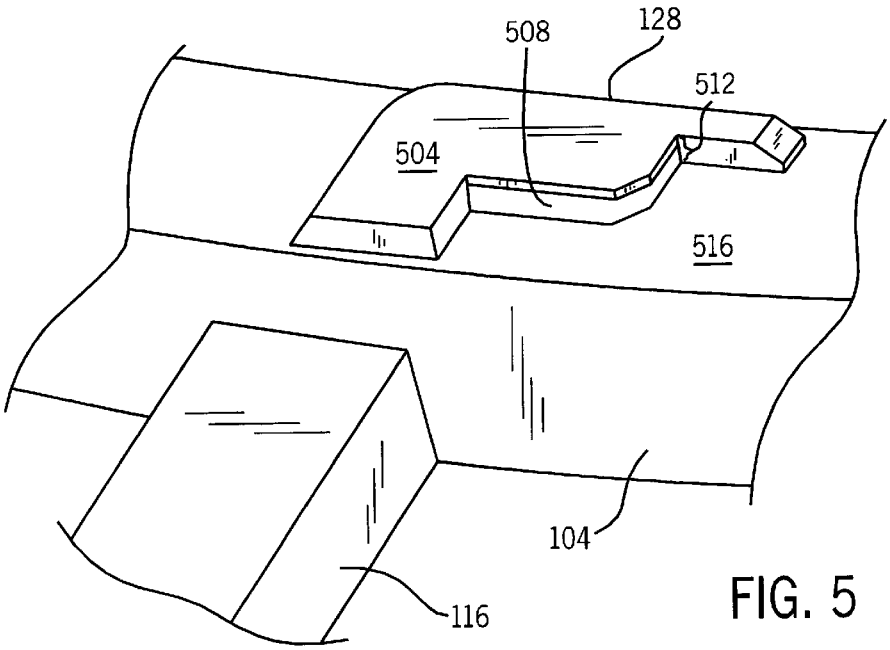
FIG. 5 is a cut-away side perspective view of an empty chair-leg socket of a rocker rung component.

FIG. 5 shows the rocker rung 104 with an alternate form of the socket 128. The socket 128 has a socket cover 504, a socket opening 508, a socket depth 512, and a socket bottom 516. A chair-leg flange 232 (shown in FIG. 6) can fit between the socket cover 504 of FIG. 5 and the socket bottom 516 into the socket opening 508. The chair-leg flange has a thickness of less than or approximately equal to the socket depth 512. Of course, the exact placement and shape of the socket 128 are not critical, but are designed and placed advantageously as shown to retain simplicity and a slip-free character. It should be noted in particular that the of design the socket 128 of FIG. 5 is interchangeable (depending on the requirements of the particular chair) with the design of the socket 124 of FIG. 3, and these two designs illustrate that a number of embodiments are possible by varying the shape, size and placement of the sockets 128.

Figure 6:
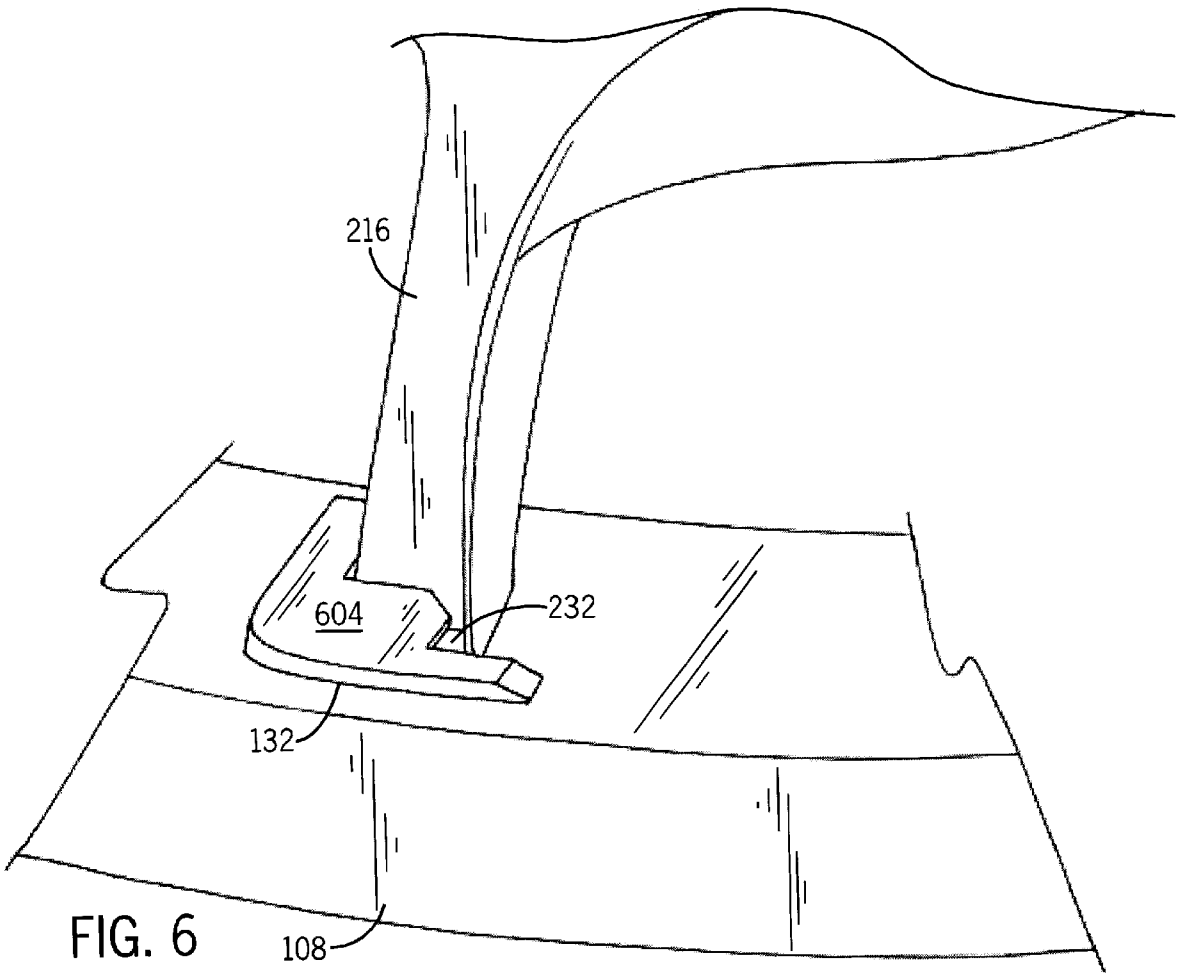
FIG. 6 is a cut-away side perspective view showing a chair-leg socket of a rocker rung component with a chair leg therein.

FIG. 6 shows the coupling of the chair leg 216 with the socket 132 in the rocker rung 108. The socket 132 again has the socket cover 604, and the socket bottom 516 (hidden from view). The chair leg flange 232 fits between the socket cover 604 and the socket bottom 516 (see FIG. 5). The force that would be produced by the bending of the leg 216 prevents the leg 216 from slipping inwardly, parallel to the surfaces of the socket cover 604 and the chair-leg flange 232. The socket cover 604 and the socket bottom prevent vertical slipping.

While several preferred embodiments have been shown and described, it is understood that changes and modifications can be made without departing from the invention's broader aspects. For example, the shape of the rocker rungs can be varied, the rocker rungs can be a made to a single piece, the placement and shape of the sockets can be varied, the number of sockets can be varied (for instance two sockets can be used with a hinge or fastener hinge system), the shape of the chair-leg flanges can vary in design or position, or a latch, pin or other simple connector can be used within the sockets to further ensure a lack of slipping, or to ensure no slipping in the absence of elastic counter-forces. Thus it is apparent that alternate embodiments will be available to those skilled in the relevant art with the present disclosure.

What is claimed is:

1. A rocking chair conversion component, comprising a first arcuate member forming a rocking chair rung; and said first arcuate member further comprising a first socket for receiving a part of a chair leg and said socket further comprising a socket cover and a socket bottom in substantially parallel relationship;

a second socket, disposed on said first arcuate member such that said first socket is positioned on one side of a transverse center line of said first arcuate member and said second socket is positioned on another side of the transverse center line of said first arcuate member with said second socket comprising a socket cover and a socket bottom in a substantially parallel relationship wherein said first and second sockets comprise front sockets of said arcuate members which fit within said first and second arcuate members, such that said socket covers for said front sockets are flush with the tops of said first and second arcuate members;

at least one rung connector affixed to said front arcuate member and coupled to a second arcuate member; and said at least one rung connector positioned so that its longest axes is perpendicular to the curved axes of first and second said first and second arcuate members, thereby coupling both of said first and second arcuate members.

2. The component of claim 1, wherein the second socket comprises two rear sockets disposed-in said first and second arcuate members, respectively, and are at least partially raised above said first and second arcuate members, such that socket covers for said two rear sockets lie in a curved plane parallel to but above the top curved plane of the first and second arcuate members.

3. The component of claim 2, wherein each of said front sockets is open only along the side bounded by at least one of the straight edges of the socket bottom.

4. The component of claim 3, wherein each of said rear sockets is open along each side bounded by a straight edge of the socket bottom.

* * * * *

UNITED STATES PATENT AND TRADEMARK OFFICE

CERTIFICATE OF CORRECTION

PATENT NO. : 6,416,123 B1
DATED : July 9, 2002
INVENTOR(S) : Michael J. Bell

It is certified that error appears in the above-identified patent and that said Letters Patent is hereby corrected as shown below:

Column 2,
Line 11, “are can be” is changed to -- can be --.
Line 12, “to the fit” is changed to -- to fit the --.

Column 3,
Line 60, “of design” is changed to -- design of --.

Column 4,
Line 4, “disposed-in” is changed to -- disposed in --.
Lines 49 and 50, “first and second”, first occurrence is removed as it is a duplication.

Signed and Sealed this

Thirtieth Day of March, 2004

JON W. DUDAS
*Acting Director of the United States Patent and Trademark Office*